US005772043A

United States Patent [19]

Saveliev

[11] Patent Number: 5,772,043

[45] **Date of Patent: *Jun. 30, 1998**

[54] SYSTEM AND METHOD FOR SEPARATING ELECTRICALLY CONDUCTIVE PARTICLES

[75] Inventor: Vladimir Saveliev, Alamaty, Kazakhstan

[73] Assignee: Particle Separation Technologies, Woodland, Utah

[ * ] Notice: The term of this patent shall not extend beyond the expiration date of Pat. No. 5,439,117.

[21] Appl. No.: 516,347

[22] Filed: Aug. 8, 1995

Related U.S. Application Data

[63] Continuation-in-part of Ser. No. 172,431, Dec. 22, 1993, Pat. No. 5,439,117.

[51] Int. Cl.[6] ..... B03C 1/26

[52] U.S. Cl. ..... 209/212; 209/214; 209/215; 209/636

[58] Field of Search ..... 209/212, 213, 209/215, 214, 223.1, 228, 231, 636, 638

[56] References Cited

U.S. PATENT DOCUMENTS 1,829,565 10/1931 Lee .
3,448,857 6/1969 Benson et al. .
4,137,156 1/1979 Morey et al. .
4,238,323 12/1980 Zakharova .
5,057,210 10/1991 Julius .
5,064,075 11/1991 Reid .
5,161,695 11/1992 Roos .

FOREIGN PATENT DOCUMENTS 784922 12/1980 U.S.S.R. .

*Primary Examiner*—Karen M. Young
*Assistant Examiner*—Douglas Hess
*Attorney, Agent, or Firm*—Thorpe, North & Western, L.L.P.

[57] ABSTRACT

A system and method for separating an electrically conductive particulate material, such as gold, from other materials. A ferromagnetic core is formed in a torroidal-like shape and is provide with a gap. A coil is wound around the core and an alternating current is applied to the coil to induce an alternating magnetic field at the gap. A stream of particles is directed into the gap. The frequency of the alternating current is set according to the specific resistivity of the particulate material which is to be separated from the rest of the material and according to the size of the particles which are to be separated from the rest of the material. By properly adjusting or setting the frequency of the alternating magnetic field, the first particles are imparted a trajectory which is different than the trajectory of the second particles in the particle stream. In order to account for the size of the particle, the present invention increases the frequency of the alternating magnetic field as the size of the first particles decreases. The present invention has particular application for separating particles of gold from other materials.

25 Claims, 3 Drawing Sheets

SYSTEM AND METHOD FOR SEPARATING ELECTRICALLY CONDUCTIVE PARTICLES

RELATED APPLICATIONS

This application is a continuation of U.S. patent application Ser. No. 08/172,431 filed on Dec. 22, 1993, (now U.S. Pat. No. 5,439,117) entitled SYSTEM AND METHOD FOR SEPARATING ELECTRICALLY CONDUCTIVE PARTICLES.

BACKGROUND

1. The Field of the Invention

This invention relates to apparatus used to separate particles consisting of one material from one or more other materials. More particularly, the present invention relates to apparatus and methods utilizing electromagnetic force to separate particles consisting of one electrically conductive material of interest, such as a valuable metal, from other conductive and nonconductive materials.

2. The Prior Art

There are many occasions in scientific and industrial applications where materials must be separated from one another. Particularly in the mining industry, valuable metals must be efficiently separated from other materials which are found in the ore.

In many industrial applications, separation of particles having different sizes and densities relies on the earth's gravity as well as some additional process such as filtration. All such arrangements which have been devised utilizing gravity to separate particles of different densities include one or more drawbacks as are recognized in the art. For example, such arrangements may require water as a carrier for the particles to be separated. Disadvantageously, the water must be removed from the particles after separation. Moreover, in some mining locations, water is not readily available.

In order to provide efficient separation without water, various apparatus and techniques have been proposed which also utilize some electromagnetic properties of materials, rather than density alone, to separate materials. While the task of separating magnetic materials from nonmagnetic materials is a relatively easy one, the task of separating a nonmagnetic materials from other nonmagnetic materials utilizing the magnetic properties of the materials has been the subject of research in the industry. Still, many problems and drawbacks exist with the proposed schemes. Particularly in the mining industry, there have been numerous attempts to separate materials from one another, for example gold from other materials, based on the differing magnetic properties of the materials.

One example of a previous scheme is represented by U.S. Pat. No. 5,057,210 to Julius. The Julius reference recognizes that the creation of eddy currents in conductive materials allows a magnetic field to move a nonmagnetic material. The Julius reference, however, utilizes rotating permanent magnets to generate a changing magnetic field and thus does not recognize critical aspects of the use of induced eddy currents in electrically conductive, nonmagnetic materials as will be explained shortly.

Another example of a previous scheme is represented by U.S. Pat. No. 5,161,695 to Roos. The Roos reference also recognizes that the creation of eddy currents in conductive materials allows a changing magnetic field to move particles of a nonmagnetic material. The Roos reference, however, utilizes permanent magnets, as does the Julius reference, and thus does not recognize critical aspects of utilizing induced eddy currents to cause movement of nonmagnetic particles. The scheme of the Roos reference is ineffective as will be apparent shortly.

In view of the shortcomings inherent in the previously proposed schemes to separate nonmagnetic materials using magnetic force, it would be a significant advance in the art to provide a more efficient system and method of separating electrically conductive nonmagnetic materials.

BRIEF SUMMARY AND OBJECTS OF THE INVENTION

In view of the above described state of the art, the present invention seeks to realize the following objects and advantages.

It is a primary object of the present invention to provide a practical system and method for separating electrically conductive nonmagnetic materials.

It is also an object of the present invention to provide a system and method for separating electrically conductive nonmagnetic materials which does not rely on moving mechanical parts to achieve separation of the materials.

It is a further object of the present invention to provide a system and method for separating electrically conductive nonmagnetic materials from each other which does not require any liquid.

It is also an object of the present invention to provide a system and method for separating electrically conductive, nonmagnetic particles wherein an magnetic field which induces eddy currents in the particles also causes movement of the particles which are to be separated.

It is a still further object of the present invention to provide a system and method for separating electrically conductive, nonmagnetic particles which could not otherwise be separated using flotation or filtration schemes.

It is also an object of the present invention to provide a system and method for separating electrically conductive, nonmagnetic particles wherein characteristics such as the specific resistivity and the size of the particle determine the separation of one material from other materials.

These and other objects and advantages of the invention will become more fully apparent from the description and claims which follow or may be learned by the practice of the invention.

The present invention provides a system for separating a first electrically conductive particulate material from one or more other materials. The present invention is particularly intended for use with materials in particulate form but can also be used with materials in other forms. The present invention can also be used in conjunction with other separation technologies, such as flotation and filtration, which are known in the art. For example, the separation techniques of the present invention can be used before or after materials have been subjected to other separation techniques known in the art.

The present invention includes means for localizing a magnetic field at a first location. The magnetic field is an alternating or oscillating field. It is preferred that the magnetic field have a strength of at least 1 kilogauss (kGs) and have a frequency of, for example, at least 10 kilohertz (kHz). In contrast with the prior art, the present invention considers the size of the particle when selecting the frequency. As the size of the particle to be separated decreases, the frequency preferably increases. For example, a frequency of 10 kHz may be used for the largest particles needing separation, a frequency of 20 kHz if medium size particles are to be separated, and a frequency of 40 kHz or higher for the smallest particles which are to be separated.

The means for localizing a magnetic field can desirably include a core of ferromagnetic material formed in a torroidal-like shape, at least one gap formed in the core, and an electrical conductor wound around the core, the conductor being capable of carrying electrical current and inducing a magnetic flux in the gap. Alternatively, other structures which can be devised by those skilled in the art can function as the means for localizing. For example, a coil with a plurality of gaps and without a core can function as the means for localizing.

A means for directing a material stream to the gap is also provided. The material stream comprises both the desirable first particles which consist of an electrically conductive, nonmagnetic material and a second material which can consist of one or a plurality of other materials. A means for setting the velocity of the material stream is preferably provided.

The present invention may also include means for sorting the particulate material according to size and conveying the first electrically conductive particulate material to the means for directing a material stream to the first location. As will be explained, the present invention utilizes heretofore unrecognized principles that allow separation of electrically conductive, nonmagnetic particles more efficiently than before.

The present invention exploits the characteristics of particle electrical specific resistivity and particle size. Thus, in contrast to the previously proposed schemes, the present invention considers the size of the particles in the separation process. For example, some embodiments of the present invention preferably include means for sorting particles having a diameter not larger than about five millimeters and more preferably not larger than about two millimeters. Embodiments of the present invention may also comprise means for measuring the size of the particles of the electrically conductive particulate material so that the operation of the system can be adjusted for best efficiency. Moreover, in contrast to the previously proposed schemes, the present invention considers the specific resistivity of the particles in the separation process.

The present invention also includes means for generating an alternating current and for applying it to the means for localizing a magnetic field. The frequency of the alternating current is set according to the specific resistivity (or conductivity) of the desired material and the size of the particles comprising the desired material. Selected embodiments of the present invention preferably include means for increasing the frequency of the alternating current as the size of the first particles decreases.

The means for localizing a magnetic field and the means for generating an alternating current cooperate together to induce an alternating magnetic field at a location, for example the gap, where separation occurs. Separation occurs as a result of the alternating magnetic field deflecting the path of the desired material a different amount than the other material present in the stream is deflected. Structures are also included to function as a means for gathering the first particles as they are separated from the material stream.

The method of the present invention preferably includes the steps of generating an alternating magnetic field, introducing a stream of particles into the magnetic field, the stream of particles including both the desired first particles and undesired second particles. The step of adjusting the frequency of the alternating magnetic field is carried out in accordance with the specific resistivity and the size of the first particles. By properly adjusting or choosing the frequency of the alternating magnetic field, the first particles are imparted a trajectory which is different than the trajectory of the other particles in the particle stream. In order to adjust for the size of the particle, the present invention increases the frequency of the alternating magnetic field as the size of the first particles decreases.

Since the size of the particles greatly influences the separation process, it may be desirable to pre-sort the particles according to size or adjust the size of the particles before being subjected to the alternating magnetic field. Moreover, it is desirable to adjust the velocity of the particles in the particle stream as they enter the magnetic field.

The particle stream is subjected to the magnetic field for a period of time while the first particles are gathered into one location and the remaining material gathered into another location. The present invention has particular application for separating particles of gold from other materials.

BRIEF DESCRIPTION OF THE DRAWINGS

In order to better appreciate how the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

General Discussion

Figure 1:
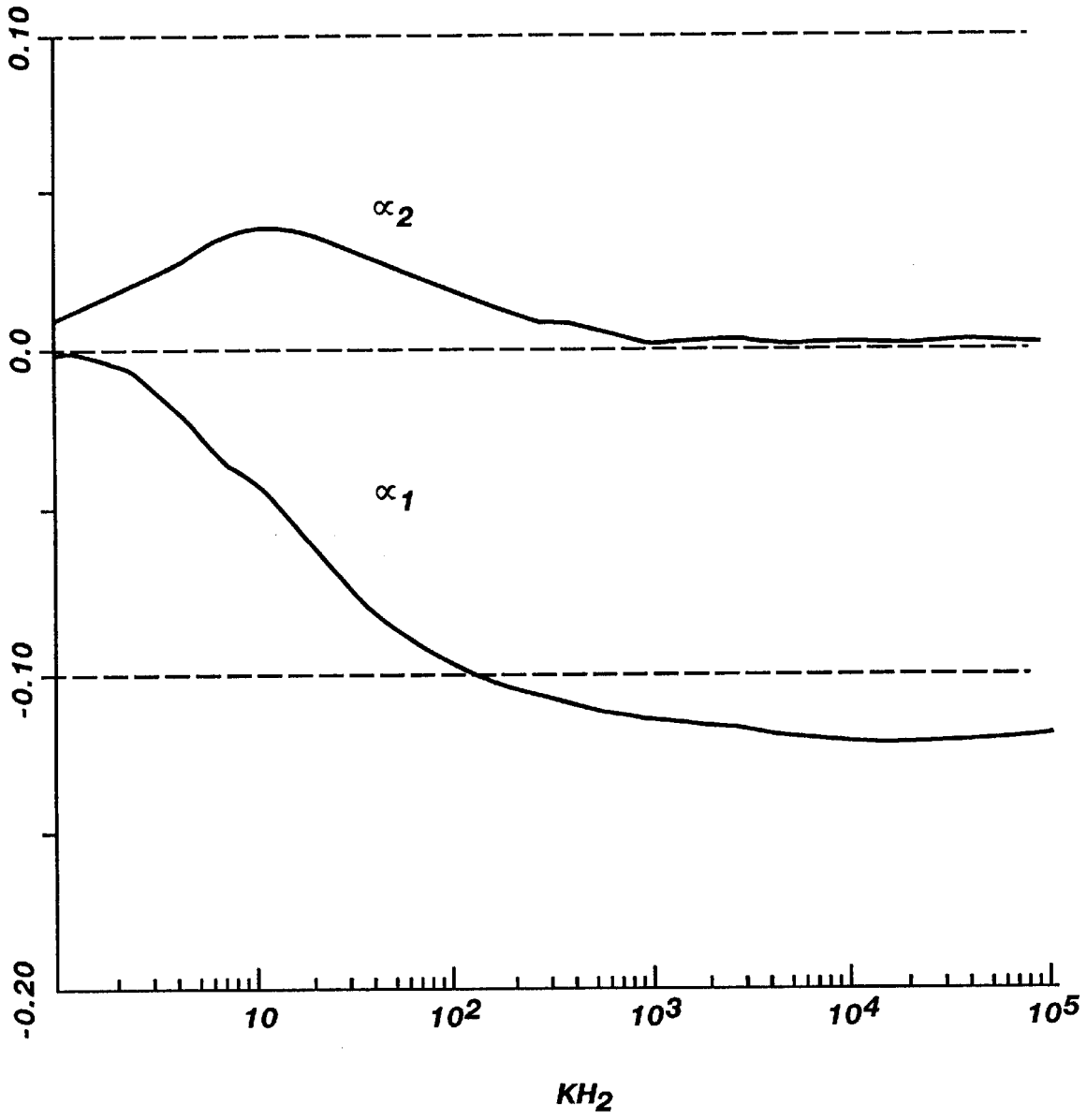
FIG. 1 is a graph showing the frequency dependence of the real and imaginary components of the coefficient of magnetic polarization for a representative material.

As explained earlier, the disadvantages of utilizing gravitational force in order to separate materials, particularly in the mining industry, has lead to the proposal of schemes which utilize the electrical properties of materials to carry out the separation. Still, the proposed scheme inherently includes several drawbacks and disadvantages which have hitherto not been recognized.

In order to most clearly explain the operation of the present invention, and the critical differences between the present invention and the existing art, a general discussion setting forth the underlying principals of the present invention will first be provided followed by examples of specific embodiments utilizing the principals of the present invention.

In the following discussion and examples, the illustrative material to be separated and gathered is gold. It is to be understood, however, that the present invention, in contrast to some teachings in the prior art, can be used to separate many different electrically conductive materials, both precious metals and other conductive materials. Gold is used as an example because of the interest in the mining industry to separate gold particles from other materials either in a gold mining operation or as a secondary product in some other type of mining operation. Gold is a very dense element, having a density of 19.3 gram/cm$^3$, which makes it possible to separate gold using sedimentation, flotation, or some other technique involving the force of gravity as has been common in the mining industry. Still, there are some circumstances where these techniques cannot be used and where the present invention is particularly advantageous.

The present invention utilizes the differences in the specific resistivity between different electrically conductive materials. As is well known, gold is a good electrical conductor having specific resistivity (R) of 2.42 $\mu\Omega\cdot$cm. As will be explained more fully shortly, the present invention also considers, in contrast to the prior arrangements, the size of the particle.

In a magnetic field, the force exerted on an electrically conductive particle possessing a magnetic moment $\vec{M}$ is expressed by Expression (1).

$$\vec{F}_B=(\vec{M}\cdot\vec{\nabla})\vec{B}=(\vec{\nabla}\vec{B})\cdot\vec{M}, \tag{1}$$

where $$\vec{\nabla}=\left(\frac{\partial}{\partial x},\frac{\partial}{\partial y},\frac{\partial}{\partial z}\right),$$

$\vec{M}$ is magnetic moment.

The force $\vec{F}$ is used in accordance with the present invention to move selected electrically conductive, nonmagnetic particles in a desired direction, while not substantially moving or moving to a lesser extent other particles, as will be described. Nonmagnetic materials, including particles consisting of gold and other precious and valuable metals, do not inherently exhibit their own magnetic moment $\vec{M}$. But electrically conductive particles can exhibit their own magnetic moment $\vec{M}$ if subjected to an alternating magnetic field.

$$\vec{B}=\vec{B}_0e^{-i\omega t} \tag{2}$$

When a conductive particle is subjected to an alternating magnetic field, the magnetic moment $\vec{M}$ which is acquired by the particle is attributed to eddy currents, also referred to as Foucault currents, induced in the particle by the electric field. Expression (3) describes the magnetic moment $\vec{M}$ acquired by a particle.

$$\vec{M}=\alpha V\vec{B}, \tag{3}$$

It will be appreciated that in Expression (3), $\alpha$ is a coefficient of magnetic polarization and $V=4/3\pi a^3$ represents the volume of a particle. The coefficient of magnetic polarization ($\alpha$), in turn, depends on the magnetic field frequency $f=2\pi\omega$, the specific resistivity of the material R (which in the case of a gold particle will be taken as 2.42 $\mu\Omega\cdot$cm), and the diameter of the particle d=2a. Expression (4) provides a value for the coefficient of magnetic polarization ($\alpha$). See Landau, L. D. & Lifshitz, E. M., *Elektrodianamika sploshnyh sred* Moscow (1982) which is now incorporated herein by reference.

$$\alpha=-\frac{3}{8\pi}\left[1-\frac{3}{a^2k^2}+\frac{3}{ak}\,ctgak\right],\ k=(1+i)/\delta \tag{4}$$

From Expression (4), it will be seen that the coefficient of magnetic polarization is a complex variable which includes real and imaginary parts as shown in Expression (5).

$$\alpha=\alpha_1+i\alpha_2 \tag{5}$$

Reference will now be made to FIG. 1. FIG. 1 is chart showing the frequency dependence of the real part $\alpha_1$ and the imaginary part $\alpha_2$ of the coefficient of magnetic polarization $\alpha$ for a particle of gold having a radius (a) equal to 1 mm.

From the data set forth in FIG. 1, it will be appreciated that the force acting upon a particle being subjected to a magnetic field which is alternating or oscillating in time is actually a composite of two oscillating functions: magnetic field and magnetic moment $\vec{M}$. Importantly, the magnetic moment $\vec{M}$ is delayed in phase by an angle expressed by: $\phi=\arctan(\alpha_1/\alpha_2)$.

Significantly, it should be appreciated that (a) the size of the particle, (b) the resistivity of the particle, and (c) the frequency of the oscillating magnetic field must all considered when separating electrically conductive, nonmagnetic particles such as gold. The previously proposed techniques and methods have all ignored one or more of these parameters.

When the frequency at which the magnetic field oscillates is relatively low, the calculated depth of the "skin layer" $\delta$ is much greater than particle size d. As will be understood by those skilled in the art, the so-called skin effect is the tendency of alternating currents to flow only near the surface of a conductor. The skin effect becomes more pronounced as the frequency of the alternating or oscillating current increases.

The depth below the surface of the particle at which the current density decreases to an established ratio of the value of the current density at the surface of the particle is referred to herein as the "skin layer." When the depth of the skin layer is much greater than the size of the particle the coefficient of magnetic polarization $\alpha$ is purely imaginary. This condition is shown by Expression (6).

$$\alpha_2 >> -\alpha_1 \text{ when } \delta >> d,\ \delta=\frac{1}{2\pi}\sqrt{\frac{R}{f_{KHZ}}}\ \text{[cm]} \tag{6}$$

In the case where the depth of the skin layer $\delta$ is much greater than the size of the particle, the phase of the magnetic moment $\vec{M}$ lags the magnetic field by $\pi/2$. Because the phase of the magnetic moment $\vec{M}$ lags the magnetic field by $\pi/2$ the force acting upon a particle oscillates at a double frequency resulting in the average value of the force ($\vec{F}_B$) applied to the particle being equal to zero as expressed by Expression (7).

$$\vec{F}_B\sim e^{-2i\omega t},\ \langle\vec{F}_B\rangle=0,\ \text{when } \delta>>d \tag{7}$$

In contrast, at relatively high frequencies, that is when the depth of the skin layer $\delta$ is much smaller than the particle size d, the coefficient of magnetic polarization $\alpha$ is purely real, i.e., $-\alpha_1 >> \alpha_2$, when $\delta << d$. In the case where the frequency is high enough, the time-averaged value of the force $<\vec{F}_B>$ applied to the particle is not equal to zero but becomes equal to a half-value of amplitude as represented by Expression (8).

$$<\vec{F}_B> = \tfrac{1}{2}\alpha_1 V \vec{B}_0 \cdot \vec{\nabla}\vec{B}_0 = \tfrac{1}{4}\alpha_1 V \vec{\nabla} B_0^2, \text{ when } \delta << d \tag{8}$$

From the preceding explanation, it will be understood that as the frequency increases to a point where a limit-derived magnetic particle polarization is reached the averaged dynamic movement of a particle (that is the movement of the particle averaged over many high frequency cycles) is determined by superposition of the magnetic force $<\vec{F}_B>$ and the ambient gravitational force $m\vec{g} = -\vec{\nabla}u$ which leads to Expression (9).

$$\vec{F} = \frac{\alpha_1 V}{4}\vec{\nabla}B_0^2 - \vec{\nabla}u = -\vec{\nabla}\left(u - \frac{\alpha_1 V}{4}B_0^2\right), \tag{9}$$

where u=mgz (the potential energy of a particle $\epsilon$ a gravitational field).

From the preceding discussion, it will be appreciated that the movement of a particle in a magnetic field which is oscillating at an appropriately "high" frequency, as defined above, is equivalent to movement of the particle in a potential field with effective potential energy $U_{eff}$ as described in Expression (10).

$$\vec{F} = -\vec{\nabla}U_{eff},\ U_{eff} = mgz - \alpha_1/4VB_0^2 \tag{10}$$

As will be appreciated by those skilled in the art, the integral of the movement described by Expression (10) is effective full energy as set forth in Expression (11).

$$\epsilon_0 = \frac{mv^2}{2} + mgz - \frac{\alpha_1}{4}VB_0^2 \tag{11}$$

From the integral expressed in Expression (11), an absolute value of the particle's speed can be expressed as set forth in Expression (12).

$$v^2 = \frac{2}{m}\epsilon_0 - 2gz + \frac{\alpha_1}{2\rho}B_0^2 \tag{12}$$

As will be appreciated, $\rho$ represents the density of gold, which is assumed to equal 19.3 g/cm$^3$. The coefficient of polarization, at an appropriately high frequency, is given by $$\alpha_1 = -\frac{3}{8\pi}\left(1 - \frac{3\delta}{d}\right).$$

From the foregoing, it will be appreciated that the present invention recognizes those principals which are necessary to efficiently separate nonmagnetic, electrically conductive particles which have heretofore not been understood and not recognized in the art. Having explained the quantitative considerations of the present invention, the apparatus of the present invention will be explained.

Apparatus of the Present Invention

The apparatus of the present invention efficiently separates electrically conductive, nonmagnetic particles based upon the particle's size and the particle's specific electrical resistivity. Thus, one type of desired electrically conductive, nonmagnetic particle can be readily separated from other undesired electrically conductive, nonmagnetic particles in accordance with the present invention. Thus, even if the desired and undesired particles are of substantially the same particle size, but the particles have different specific electrical resistivities, the particles can be separated from one another using the present invention. From Expression (10) it will be appreciated that the desired particle is pushed out from the oscillating magnetic field, i.e., its trajectory is altered, and the undesired particles are substantially unaffected by the oscillating magnetic field and thus pass through without substantial alteration of their trajectories.

The present invention can be carried out so that particles can be separated from each other in a batch-by-batch fashion or in a continuous flow process. The continuous flow process is presently preferred and more efficient. Thus, the apparatus described herein are all of the continuous flow type. The present invention can, however, be adapted to batch processing. As explained earlier, gold particles will be described herein as exemplary desired particles. It is to be understood that the present invention has equal applicability with other suitable materials.

The magnitude of the separation effect on a particle is represented by Expression (13). Expression (13) shows an exemplary numeric value of the velocity which a desired particle acquires as it is moved out of the locality of the oscillating magnetic field having a strength equal to $B_0$.

$$v_B = \sqrt{\frac{-\alpha_1}{2\rho}}\ B_0 = 55.6 \cdot B_{KGS}[\text{cm/sec}] \tag{13}$$

From Expression (13), it will be appreciated that a particle subjected to an oscillating magnetic field having a strength of about 1 kGs acquires a velocity of about 0.5 m/sec. Moreover, this velocity will be in one or more predetermined directions in relation to the oscillating magnetic field. Thus, as will be explained in greater detail shortly, separation of the desired particles from the undesired particles can occur by changing the trajectory of the desired particles when they pass through the locality of the oscillating magnetic field, whereas the trajectory of undesired particles doesn't substantially change and the particles will pass through as if the oscillating magnetic field didn't exist.

As will now be appreciated, the present invention requires the creation of an oscillating, also referred to herein as an alternating, magnetic field of the proper frequency and of sufficient strength. Those skilled in the art will readily appreciate which of the components available in the art can be used to generate an oscillating signal of sufficient strength and of high enough frequency to move the desired particles.

Figure 2:
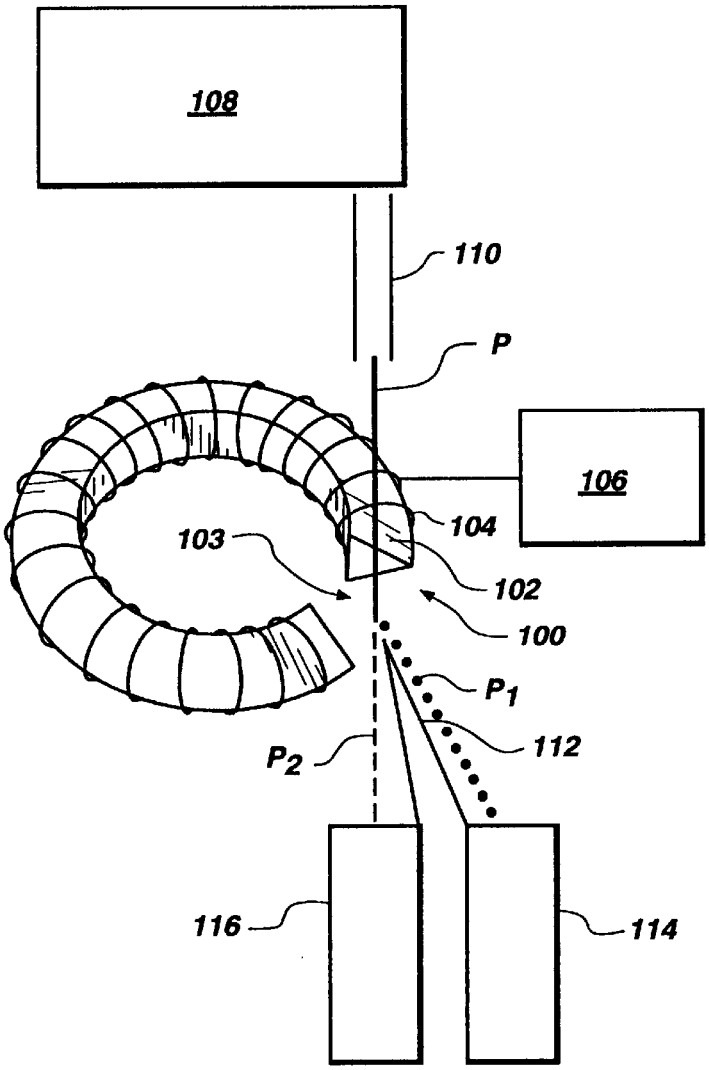
FIG. 2 is a diagrammatic representation of a first preferred embodiment of the present invention.
Figure 3:
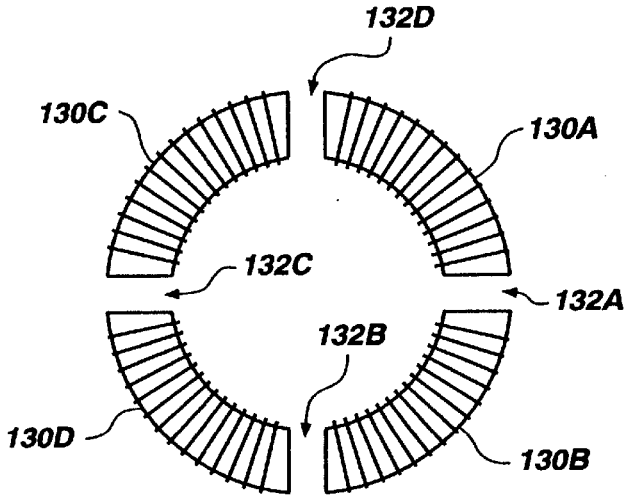
FIG. 3 is a diagrammatic representation of a second preferred embodiment of the present invention.
Figure 4:
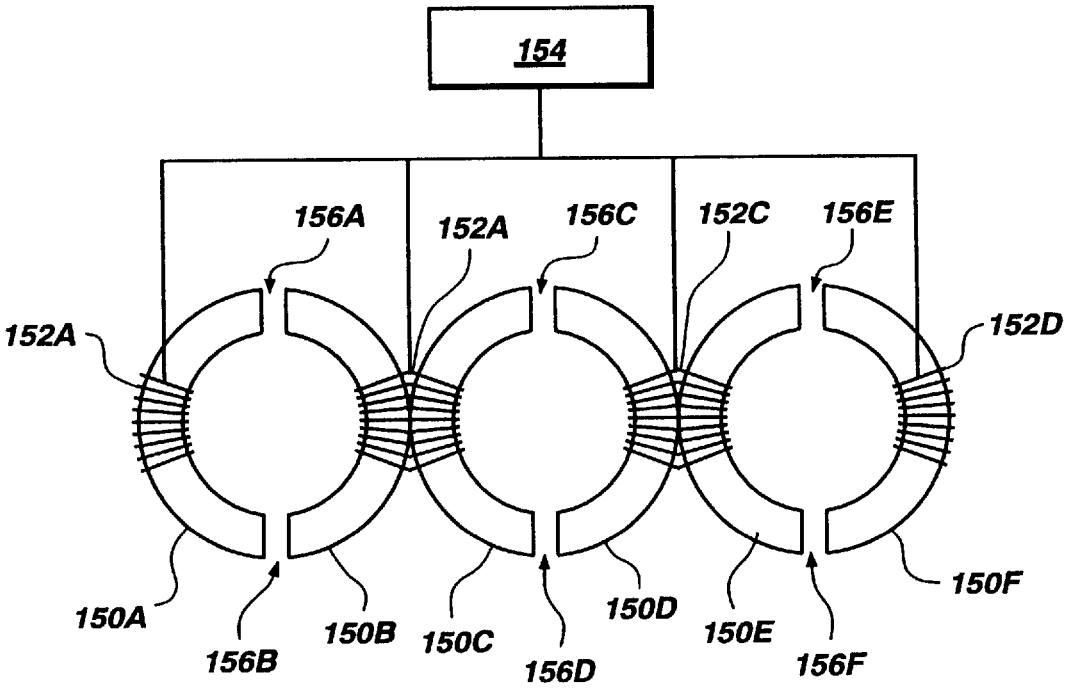
FIG. 4 is a diagrammatic representation of a third preferred embodiment of the present invention.

FIGS. 2–4 illustrate preferred structures used for carrying out the present invention. FIG. 2 is a diagrammatic representation of a first presently preferred embodiment for carrying out the present invention.

Represented generally at 100 in FIG. 2 is a magnetic field localizer. The magnetic filed localizer 100 functions to focus and localize the magnetic field at a gap generally represented at 103.

The magnetic field localizer 100 includes a core 102 whose preferred triangular cross sectional shape can be seen at the cross sectional view provided at the gap 103. The core 102 is shaped similarly to a torus and is closed except for the gap 103. The closed shape more efficiently localizes the magnetic field at the gap 103. Other shapes which are now known or which may be devised in the future can also be used. For example, the cross sectional shape of the core 102 can also preferably be rectangular.

Ferrite is the preferred material for the core 102. As is known in the art, the term ferrite refers to a group of materials which provide good magnetic properties but which are relatively poor conductors of electrical current. Thus, any number of materials which share this characteristic should be considered as preferred candidates for the material from which the core 102 is fabricated. It is also preferred to laminate the core 102 as is known in the art to reduce electrical losses.

A coil 104 is wrapped around the core 102. The representation of the coil 104 in the figures provided herein is diagrammatic only and is not intended to limit the type of coil-like structure which is provided about the core. It will be appreciated that many different structures can be used as the coil 104. Any structure which allows an oscillating electrical current passing therethrough to induce a corresponding flux in the gap 103 can function as the coil 104.

A frequency generator 106 provides alternating or oscillating electrical current to the coil 104. The frequency generator 106 should be able to provide sufficient current to induce a magnetic field of substantial strength at the gap 103. For example, field strengths of about 1 kGs to about 10 kGs are preferred. Greater or smaller field strengths may also be used. Those skilled in the art can readily obtain commercially available generators capable of providing sufficient currents to carry out the present invention in a frequency range of from about 10 kHz to about 10 mHz. Such frequency generators are widely used for induction heating applications.

From the foregoing discussion, when gold particles having a radius of about 1 mm and larger are to be separated, the frequency generator 106 must provide a signal at least as great as about 20 kHz. As the size of particles decreases the frequency output from the frequency generator 106 must increase in order to maintain the efficiency of the separation operation. A ten fold decrease in the size of the particles requires that the frequency of the frequency generator 106 must be increased 100 times to maintain the efficacy of the separation. The minimum size of particles which can be separated by the present invention is limited by the highest frequency that can be produced and should satisfy the condition: $-\alpha_1 \gtrsim \alpha_2$ or $\delta \lesssim d$.

It is to be understood that the signal which is output from the frequency generator 106 need not be stabilized and that the wave form of the alternating signal which is output need not be strictly sinusoidal.

The apparatus represented in FIG. 2 also includes a particle conditioning unit 108. The particle conditioning unit 108 carries out such tasks as providing properly and relatively uniformly sized particles. Particle conditioning can include, for example, adjusting the size of particles, determining the size of the particles, and sorting the particles according to size using various means known in the art for carrying out that purpose. Since the size of the particles determines the separation results, the particle conditioning unit 108 preferably regulates the size of the particles passing into the gap 103. The particle conditioning unit 108 can also carry out whatever other tasks which will improve the efficiency of the separation.

A particle director 110 receives the particles from the particle conditioning unit 108 and directs them to the gap 103 in an orderly fashion. It will be appreciated that the dimensions of the stream of particles entering the gap 103 will influence the efficiency of the separation. Moreover, the velocity of the particles as they enter the gap 103 will also influence the efficiency of the separation. Thus, the particle director 110 desirably includes structures to monitor the dimensions of the particles in the stream and to control the velocity of the particles as they enter the gap 103.

Figure 2A:
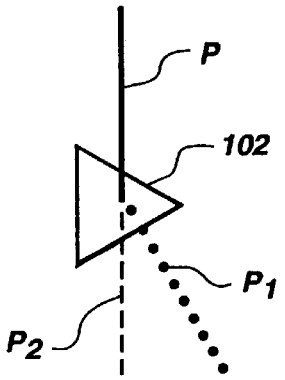
FIG. 2A is a diagrammatic representation of the operation of the of the embodiment of FIG. 1.

FIG. 2A is a cross sectional view of the core 102 with the particles which emerge from the particle director 110 being represented by a solid line P. FIG. 2A diagrammatically represents the action of the present invention as the particle stream P enters the location of the magnetic field in the gap 103. The particle stream can include desired gold particles and any number of different undesired particles. As the particle stream falls under the force of gravity into the location of the magnetic field, the desired gold particles are moved out of the particle stream P by acquiring a new trajectory indicated by dots $P_1$. The undesired remaining particles, represented by dashes $P_2$, from the particle stream P, continue in substantially the same downward trajectory.

While the presently preferred arrangements for carrying out the present invention utilize gravity to move the desired particles out of the particle stream P, it will be appreciated that a force other than gravity could be used to move the particle stream P into the location of the magnetic field. Moreover, it will be appreciated that the magnetic field localizer 100 must be properly oriented in relation to the particle stream P for efficient separation. The trajectory of gold particles $P_1$ is similar to that of a light ray passing through an optical prism. Thus, the operation of the apparatus represented in FIGS. 2 and 2A can be described as a "magnetic prism."

As diagrammatically shown in FIG. 2, after the trajectories of the desired gold particles $P_1$ has been sufficiently altered, a separation plate 112 gathers the gold particles $P_1$ into a first collection area 114 while the remaining particles are allowed to fall into a second collection area 116.

FIG. 3 represents another example of a magnetic field localizer. The magnetic field localizer illustrated in FIG. 3 includes four core and coil sections 130A–D and four gaps 132A–D. The four core and coil sections 130A–D may all be driven from same frequency generator such as frequency generator 106 in FIG. 2. Moreover, each gap 132A–D can be provided with corresponding particle directors, such as particle director 110 in FIG. 2, and separation plates, such as separation plate 112 in FIG. 2. In this way, the efficiency of the separation system can be increased.

After consideration of the information set forth herein, those skilled in the art will appreciate that a magnetic field localizer can include tens, or even hundreds, of structures which function as the gaps 132A–D. Moreover, it is possible to omit a core from the coil structure. As is known in the art, as the frequency of an alternating magnetic field is increased, the inclusion of a core will result in greater loses and lower electrical efficiency. All of the arrangements described herein are intended to come within the scope of the means for localizing a magnetic field in accordance with the present invention.

FIG. 4 illustrates another arrangement of the present invention wherein one frequency generator 154 supplies current to a plurality of cores 150A–F and their corresponding coils 152A–D. Six gaps 156A–F are provided whereat the magnetic field is concentrated. Each gap 156A–F can be provided with corresponding particle directors, such as particle director 110 in FIG. 2, and separation plates, such as separation plate 112 in FIG. 2. It is to be appreciated that the representation provided in FIG. 4 is merely diagrammatic and is intended to indicate the benefits of coupling a plurality of cores, coils, and gaps together.

In addition to the embodiments represented in FIGS. 2–4, further embodiments of the present invention can be devised by those skilled in the art using the information contained herein. For example, it is within the scope of the present invention to arrange a number of the above-described embodiments in a serial arrangement to allow the particles which are output from a first magnetic prism to further separation by subsequent magnetic prism structures.

In view of the foregoing, it will be appreciated that the present invention provides a system and method for separating electrically conductive nonmagnetic materials which does not rely on moving mechanical parts to achieve a separation of the particles. The present invention also provides a system and method for separating electrically conductive, nonmagnetic particles wherein the magnetic field which induces eddy currents in the particles also causes movement of the particles which are to be separated and wherein both the electrical conductivity and the size of the particle determine the separation of one type of particle from other types of particles.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by united states letters patent is:

1. A system for separating a first electrically conductive particulate material from at least a second material, the system comprising:

means for localizing a magnetic field at a first location;

means for directing a material stream to the first location, the material stream comprising the first electrically conductive material and the second material;

means for generating an alternating current and for applying it to the means for localizing a magnetic field at the first location, the frequency of the alternating current being set according to the resistivity of the first material and the size of the particles comprising the first material, the means for localizing the magnetic field and the means for generating the alternating current cooperating to induce an alternating magnetic field at the first location, the alternating magnetic field deflecting the path of the first electrically conductive material a different amount than the second material is deflected as the means for directing conducts the material stream into the first location; and means for gathering the first electrically conductive particles as they are separated from the material stream.

2. A system as defined in claim 1 wherein the means for localizing a magnetic field at a first location comprises:

a core of ferromagnetic material formed in a torroidal-like shape and having a triangular cross section;

at least one gap in the core; and an electrical conductor wound around the core, the conductor capable of carrying electrical current and inducing a magnetic flux in the gap.

3. A system as defined in claim 1 wherein the means for localizing a magnetic field at a first location comprises:

a core of ferromagnetic material having a cross sectional shape comprising at least one rectangular shape; and at least one gap in the core.

4. A system as defined in claim 1 wherein the means for localizing a magnetic field at a first location consists essentially of a coreless coil having at least one triangular shape in cross section.

5. A system as defined in claim 1 wherein the means for localizing a magnetic field at a first location induces a magnetic field at the first location at least as great as one kilogauss.

6. A system as defined in claim 1 wherein the means for generating an alternating electrical current further comprises means for increasing the frequency as the size of the particles of the first electrically conductive material decreases.

7. A system as defined in claim 1 further comprising means for sorting the first electrically conductive particulate material according to size and conveying the first electrically conductive particulate material to the means for directing a material stream to said first location.

8. A system as defined in claim 7 wherein the means for sorting comprises means for sorting particles having a diameter not larger than about two millimeters.

9. A system as defined in claim 1 further comprising means for measuring the size of the particles of the first electrically conductive particulate material.

10. A system as defined in claim 1 further comprising means for adjusting the size of the particles of the first electrically conductive particulate material.

11. A system as defined in claim 1 wherein the means for generating an alternating current comprises means for generating a radio frequency signal having a frequency greater than about 10 kilohertz.

12. A system as defined in claim 1 wherein the means for generating an alternating current comprises means for generating a radio frequency signal having a frequency greater than about 20 kilohertz.

13. A system as defined in claim 1 wherein the means for generating an alternating current comprises means for generating a radio frequency signal having a frequency greater than about 40 kilohertz.

14. A system as defined in claim 1 wherein the means for generating an alternating current comprises means for increasing the frequency of the alternating current increases in relation to the size of the particles of the first electrically conductive particulate material in accordance with the inverse square law.

15. A system as defined in claim 1 wherein the means for directing a material stream comprises means for setting the velocity of the material stream.

16. A system for separating a first electrically conductive particulate material from a second material, the system comprising:

a core of ferromagnetic material formed in a torroidal-like shape;

at least one gap in the core;

an electrical conductor wound around the core, a coil capable of carrying electrical current and thereby inducing a magnetic flux in the gap;

means for generating a radio frequency signal and applying it to the coil such that an alternating magnetic field of at least one kilogauss is present in the gap, the frequency of the radio frequency signal being determined by the electrical resistivity of the first electrically conductive material and the size of the particles comprising the first electrically conductive material, the frequency of the radio frequency signal being at least 40 kHz and the frequency increasing as the size of the particles of the first electrically conductive material decreases;

means for directing a material stream into the gap, the material stream comprising the first electrically conductive material and the second material, the magnetic field deflecting the path of the first electrically conductive material a different amount than the second material is deflected; and means for gathering the first electrically conductive particles as they are separated from the material stream.

17. A system as defined in claim 16 further comprising means for sorting the particles of the first electrically conductive material according to size, the particles having a diameter not larger than about two millimeters.

18. A system as defined in claim 16 further comprising means for measuring the size of the particles of the first electrically conductive particulate material.

19. A system as defined in claim 16 further comprising means for adjusting the size of the particles of the first electrically conductive particulate material.

20. A system as defined in claim 16 wherein the means for directing a material stream comprises means for setting the velocity of the material stream.

21. A method of separating first particles of a first electrically conductive particulate material from a second material, the method comprising the steps of:

generating an alternating magnetic field;

introducing a stream of particles into the magnetic field, the stream of particles including first particles of a substantially electrically conductive material and second particles exhibiting electrical resistivity which is different than that of the first particles;

adjusting the frequency of the alternating magnetic field in accordance with the electrical resistivity and the size of the first particles such that the first particles are imparted a trajectory within the magnetic field which is different than the trajectory which is imparted to the second particles;

subjecting the stream of particles to the magnetic field for a period of time; and gathering the first particles into a first location and the second material into a second location such that the first particles and the second material are substantially separated from each other.

22. A method as defined in claim 21 wherein the first particles consist essentially of gold.

23. A method as defined in claim 21 wherein the step of generating an alternating magnetic field comprises the steps of generating an alternating magnetic field having a strength of at least one kilogauss and a frequency of at least 10 kHz.

24. A method as defined in claim 21 further comprising the steps of:

adjusting the size of the first particles of the first particulate material which is included in the stream of particles; and adjusting the velocity of the particles in the particle stream.

25. A method as defined in claim 21 wherein the step of adjusting the frequency of the magnetic field comprises the step of increasing the frequency of the alternating magnetic field as the size of the particles of the first electrically conductive material decreases.

* * * * *